US005374369A

United States Patent [19]

Angevaare et al.

[11] Patent Number: 5,374,369

[45] Date of Patent: Dec. 20, 1994

[54] SILVER ANTI-TARNISHING DETERGENT COMPOSITION

[75] Inventors: Petrus A. Angevaare, Ho-ho-kus; Richard G. Gary, West New York, both of N.J.

[73] Assignee: Lever Brothers Company, Division of Conopco, Inc., New York, N.Y.

[21] Appl. No.: 136,787

[22] Filed: Oct. 14, 1993

[51] Int. Cl.[5] ..... C11D 3/28; C11D 7/54

[52] U.S. Cl. ..... 252/102; 252/95; 252/99; 252/135; 252/156; 252/174.12; 134/25.2

[58] Field of Search ..... 252/95, 98, 99, 102, 252/174.12, 523, 542, 135, 156; 134/25.2

[56] References Cited

U.S. PATENT DOCUMENTS

| | | | |
|---|---|---|---|
| 3,332,882 | 7/1967 | Blumbergs et al. | 252/186 |
| 3,852,220 | 12/1974 | Kimmel et al. | 252/524 |
| 3,956,158 | 5/1976 | Donaldson | 252/102 |
| 3,966,627 | 6/1976 | Gray | 252/99 |
| 4,128,494 | 12/1978 | Schirmann et al. | 252/186 |
| 4,144,226 | 3/1979 | Crutchfield et al. | 528/231 |
| 4,146,495 | 3/1979 | Crutchfield et al. | 252/132 |
| 4,260,528 | 4/1981 | Fox et al. | 252/525 |
| 4,271,030 | 6/1981 | Brierley et al. | 252/98 |
| 4,431,559 | 2/1984 | Ulrich | 252/99 |
| 4,511,487 | 4/1985 | Pruhs et al. | 252/99 |
| 4,740,327 | 4/1988 | Julemont et al. | 252/103 |
| 4,752,409 | 6/1988 | Drapier et al. | 252/94 |
| 4,836,948 | 6/1989 | Corring | 252/99 |
| 4,859,358 | 8/1989 | Gabriel et al. | 252/99 |
| 4,867,896 | 9/1989 | Elliott et al. | 252/94 |
| 4,877,544 | 10/1989 | Gabriel et al. | 252/99 |
| 4,933,101 | 6/1990 | Cilley et al. | 252/99 |
| 5,089,162 | 2/1992 | Rapisarda et al. | 252/102 |
| 5,230,822 | 7/1993 | Kamel et al. | 252/174.13 |

FOREIGN PATENT DOCUMENTS

| | | |
|---|---|---|
| 1246339 | 9/1971 | Germany . |
| 907356 | 10/1962 | Netherlands . |
| 907358 | 10/1962 | Netherlands . |
| 836988 | 6/1960 | United Kingdom . |
| 855735 | 12/1960 | United Kingdom . |
| 1003310 | 9/1965 | United Kingdom . |
| 2164350 | 3/1986 | United Kingdom . |

OTHER PUBLICATIONS

Singh et al., "Silver tarnishing and its prevention–A review," Anti-Corrosion Methods Matter., 30 (Jul. 1983) 4–8.

*Primary Examiner*—Paul Lieberman
*Assistant Examiner*—Lorna M. Douyon
*Attorney, Agent, or Firm*—A. Kate Huffman

[57] ABSTRACT

A detergent composition comprising 1–20 weight percent of a peroxygen or hypohalite bleaching agent, 0.05 to about 10 weight percent cyanuric acid, from 1 to 75 weight percent of a builder; and 0 to 40 weight percent of a surfactant is described. The composition prevents tarnishing of silver and silver plated articles.

19 Claims, No Drawings

SILVER ANTI-TARNISHING DETERGENT COMPOSITION

FIELD OF THE INVENTION

This invention relates to detergent compositions based on peroxygen and hypohalite bleaching agents with cyanuric acid incorporated as a silver anti-tarnishing agent.

BACKGROUND OF THE INVENTION

Silver is chemically the most reactive element among the noble metals and tarnishes readily on exposure to sulfur bearing atmospheres. Discoloration, generally termed tarnishing, is caused by a silver oxidation process in which sulfide is formed. Food such as onions, mustard and eggs which contain organic sulfur compounds are also known to tarnish silver. See Singh et al., "Silver Tarnishing and its Prevention—A Review" Anti-corrosion Methods and Materials, v. 30 (July 1983) pp. 4–8.

Silver tarnishing is also known to occur when an oxygen bleaching agent used in detergent compositions oxidizes the silver to silver oxide. This oxidation process causes surface blackening of the silver leaving undesirable tarnishing of silverware when machine dishwashed.

Conventional detergents, particularly automatic machine dishwashing detergents, are generally formulated with chlorine bleaching agents in a high alkaline pH range. During washing, certain chlorine bleaches (e.g., chloroisocyanurate) react to form isocyanuric acid and thus do not greatly effect silver discolorization.

Detergent compositions are, however, increasingly being based on peroxygen bleaching agents and are being formulated to be milder to produce more environmentally friendly products. The problem of tarnishing of silver and silver plated articles has thus become more severe.

SUMMARY OF THE INVENTION

It is thus an object of the invention to provide a peroxygen or hypohalite bleach based detergent composition containing a silver anti-tarnishing ingredient.

It is further an object of the invention to provide an environmentally friendly detergent composition which does not cause tarnishing of silver and silver plated articles.

Another object of the invention is to provide a method for washing silver and silver plated articles without discoloring such articles.

A further object is to protect such a silver article from tarnishing from organic food stuff with which it comes in contact.

Detergent compositions formulated for use in automatic dishwashing machines or fabric washing machines which are stable in a variety of physical forms, including liquid, powder, flakes, etc., is another object of the invention.

The inventive compositions comprise 1 to 20 weight percent of a peroxygen or hypohalite bleaching agent; 0 to 40 weight percent of a surfactant; 1 to 75 weight percent of a builder; and about 0.05 to about 10 weight percent cyanuric acid.

DETAILED DESCRIPTION OF PREFERRED EMBODIMENTS

For purposes of this application, "cyanuric acid" means 1,3,5-triazine-2,4,6(1H,3H,5H)-trione, normal cyanuric acid, sym-triazinetriol, 2,4,6-trihydroxy-1,3,5-triazine, tricyanic acid or trihydroxycyanidine. The term "cyanuric acid" is also meant to include its isomer isocyanuric acid and salts corresponding to cyanuric acid and its isomer.

Cyanuric acid is present in the inventive formulations in an amount of from about 0.05 to about 10 weight percent, preferably 0.25 to about 2.5 weight percent, most preferably 0.75 to about 2 weight percent.

A commercially available source of cyanuric acid is Aldrich Chemical Co. of Milwaukee, Wis.

It is understood that compounds containing cyanuric acid and a chlorine source may also be used as a bleaching agent. Suitable compounds include trichloroisocyanuric acid, dichloroisocyanuric acid, and other salts thereof. Sources of chlorinated isocyanuric acids include ACL-59® supplied by Monsanto Company, and Clearon CDB-56® supplied by Olin Corporation.

Peroxy Bleaching Agent

The oxygen bleaching agents of the compositions include organic peroxy acids and diacylperoxides. Typical monoperoxy acids useful herein include alkyl peroxy acids and aryl peroxy acids such as:

(i) peroxybenzoic acid and ring-substituted peroxybenzoic acids, e.g., peroxy-alpha-naphthoic acid, and magnesium monoperphthalate (ii) aliphatic and substituted aliphatic monoperoxy acids, e.g., peroxylauric acid, peroxystearic acid, epsilon-phthalimido peroxyhexanoic acid, o-carboxybenzamido Peroxyhexanoic acid, N-nonenylamidoperadipic acid and N-nonenylamidopersuccinic acid.

Typical diperoxy acids useful herein include alkyl diperoxy acids and aryldiperoxy acids, such as:

(iii) 1,12-diperoxydodecanedioic acid (iv) 1,9-diperoxyazelaic acid (v) diperoxybrassylic acid; diperoxysebacic acid and diperoxyisophthalic acid (vi) 2-decyldiperoxybutane-1,4-dioic acid (vii) N,N-terephthaloyl-di(6-aminopercaproic acid).

A typical diacylperoxide useful herein includes dibenzoylperoxide.

Inorganic peroxygen compounds are also suitable for the present invention. Examples of these materials which are useful are salts of monopersulfate, perborate monohydrate, perborate tetrahydrate, and percarbonate.

Preferred organic oxygen bleaching agents include epsilonphthalimido-peroxyhexanoic acid, o-carboxybenzamidoperoxyhexanoic acid, and mixtures thereof.

The oxygen bleaching agent is present in the composition in an amount from about of 1 to 20 weight percent, preferably 1 to 15 weight percent, most preferably 2 to 10 weight percent.

The oxygen bleaching agent may be incorporated directly into the formulation or may be encapsulated by any number of encapsulation techniques known in the art to produce stable capsules in alkaline liquid formulations.

A preferred encapsulation method is described in U.S. Pat. No. 5,200,236 issued to Lang et al., herein incorporated by reference. In the patented method, the bleaching agent is encapsulated as a core in a paraffin wax material having a melting point from about 40° C. to about 50° C. The wax coating has a thickness of from 100 to 1500 microns.

Bleach Precursors

Suitable peroxygen peracid precursors for peroxy bleach compounds have been amply described in the literature, including GB Nos. 836,988; 855,735; 907,356; 907,358; 907,950; 1,003,310 and 1,246,339; U.S. Pat. Nos. 3,332,882 and 4,128,494.

Typical examples of precursors are polyacylated alkylene diamines, such as N,N,N',N'-tetraacetylethylene diamine (TAED) and N,N,N',N'-tetra-acetylmethylene diamine (TAMD); acylated glycolurils, such as tetraacetylglycoluril (TAGU); triacetylcyanurate, sodium sulphophyl ethyl carbonic acid ester. sodium acetyloxybenzene sulfonate (SABS), sodium nonanoyloxybenzene sulfonate (SNOBS) and choline sulfophenyl carbonate. Peroxybenzoic acid precursors are known in the art, e.g., as described in GB-A-836,988. Examples of suitable precursors are phenylbenzoate; phenyl p-nitrobenzoate; o-nitrophenyl benzoate; o-carboxyphenyl benzoate; p-bromophenylbenzoate; sodium or potassium benzoyloxy benzenesulfonate; and benzoic anhydride.

Preferred peroxygen bleach precursors are sodium p-benzoyloxybenzene sulfonate, N,N,N',N'-tetraacetylethylene diamine, sodium nonanoyloxybenzene sulfonate and choline sulfophenyl carbonate.

Halogen Bleaches

The combination of cyanuric acid with certain halogen bleaches (other than N-chloro imides) surprisingly prevents silver tarnishing as well. Those formulations according to the invention may include chloramines, chloramides, chlorimines, chlorosulfonamides, and chlorohydantoins, all of which yield hypochlorite anion to varying degrees under the conditions of the invention. Active halogen compounds, similar to those described above, containing bromine or bromine and chlorine can also be included for use herein.

Dry, particulate, water-soluble anhydrous inorganic salts such as lithium, sodium or calcium hypohalite, and halogenated trisodium phosphate are likewise suitable for use herein. Sodium hypohalite is preferred for liquid formulations.

Detergent Builder Materials

The compositions of this invention can contain all manner of detergent builders commonly taught for use in automatic dishwashing or other cleaning compositions. The builders can include any of the conventional inorganic and organic water-soluble builder salts, or mixtures thereof and may comprise 1 to 75%, and preferably, from about 5 to about 70% by weight of the cleaning composition.

Typical examples of phosphorus-containing inorganic builders, widen present, include the water-soluble salts, especially alkali metal pyrophosphates, orthophosphates and polyphosphates. Specific examples of inorganic phosphate builders include sodium and potassium tripolyphosphates, phosphates, pyrophosphates and hexametaphosphates.

Suitable examples of non-phosphorus-containing inorganic builders, when present, include water-soluble alkali metal carbonates, bicarbonates, sesquicarbonates, borates, silicates, metasilicates, and crystalline and amorphous aluminosilicates. Specific examples include sodium carbonate (with or without calcite seeds), potassium carbonate, sodium and potassium bicarbonates, silicates and zeolites.

Particularly preferred inorganic builders can be selected from the group consisting of sodium tripolyphosphate, potassium pyrophosphate, sodium carbonate, potassium carbonate, sodium bicarbonate, sodium silicate and mixtures thereof. When present in these compositions, sodium tripolyphosphate concentrations will range from about 2% to about 40%; preferably from about 5% to about 30%. Sodium carbonate and bicarbonate when present can range from about 5% to about 50%; preferably from about 10% to about 30% by weight of the cleaning compositions. Sodium tripolyphosphate and potassium pyrophosphate are preferred builders in gel formulations, where they may be used at from about 3 to about 30%, preferably from about 10 to about 20%.

Organic detergent builders can also be used in the present invention. Examples of organic builders include alkali metal citrates, succinates, malonates, fatty acid sulfonates, fatty acid carboxylates, nitrilotriacetates, phytates, phosphonates, alkanehydroxyphosphonates, oxydisuccinates, alkyl and alkenyl disuccinates, oxydiacetates, carboxymethyloxy succinates, ethylenediamine tetraacetates, tartrate monosuccinates, tartrate disuccinates, tartrate monoacetates, tartrate diacetates, oxidized starches. oxidized heteropolymeric polysaccharides, polyhydroxysulfonates, polycarboxylates such as polyacrylates, polymaleates, polyacetates, polyhydroxyacrylates, polyacrylate/polymaleate and polyacrylate/polymethacrylate copolymers, aminopolycarboxylates and polyacetal carboxylates such as those described in U.S. Pat. Nos. 4,144,226 and 4,146,495.

Alkali metal citrates, oxydisuccinates, polyphosphonates and acrylate/maleate copolymers are especially preferred organic builders. When present they are preferably available from about 1% to about 35% of the total weight of the detergent compositions.

The foregoing detergent builders are meant to illustrate but not limit the types of builders that can be employed in the present invention.

Surfactants

Useful surfactants include anionic, nonionic, cationic, amphoteric, zwitterionic types and mixtures of these surface active agents. Such surfactants are well known in the detergent art and are described at length in "Surface Active Agents and Detergents", Vol. II, by Schwartz, perry & Birch, Interscience Publishers, Inc. 1959, herein incorporated by reference.

Anionic synthetic detergents can be broadly described as surface active compounds with one or more negatively charged functional groups. Soaps are included within this category. A soap is a $C_8$–$C_{22}$ alkyl fatty acid salt of an alkali metal, alkaline earth metal, ammonium, alkyl substituted ammonium or alkanolammonium salt. Sodium salts of tallow and coconut fatty acids and mixtures thereof are most common. Another important class of anionic compounds are the water-soluble salts, particularly the alkali metal salts, of organic sulfur reaction products having in their molecular structure an alkyl radical containing from about 8 to 22 carbon atoms and a radical selected from the group consisting of sulfonic and sulfuric acid ester radicals. Organic sulfur based anionic surfactants include the salts of $C_{10}$–$C_{16}$ alkylbenzene sulfonates, $C_{10}$–$C_{22}$ alkane sulfonates, $C_{10}$–$C_{22}$ alkyl ether sulfates, $C_{10}$–$C_{22}$ alkyl sulfates, $C_4$–$C_{10}$ dialkylsulfosuccinates, $C_{10}$–$C_{22}$ acyl isothionates, alkyl diphenyloxide sulfonates, alkyl napthalene sulfonates, and 2-acetamido hexadecane sulfonates. Organic phosphate based anionic surfactants include organic phosphate esters such as complex mono- or diester phosphates of hydroxyl-terminated alkoxide condensates, or salts thereof. Included in the organic phosphate esters are phosphate ester derivatives of polyoxyalkylated alkylaryl phosphate esters, of ethoxylated linear alcohols and ethoxylates of phenol. Also included are nonionic alkoxylates having a sodium alkylenecarboxylate moiety linked to a terminal hydroxyl group of the nonionic through an ether bond. Counterions to the salts of all the foregoing may be those of alkali metal, alkaline earth metal, ammonium, alkanolammonium and alkylammonium types.

Nonionic surfactants can be broadly defined as surface active compounds with one or more uncharged hydrophilic substituents. A major class of nonionic surfactants are those compounds produced by the condensation of alkylene oxide groups with an organic hydrophobic material which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative, but not limiting examples, of various suitable nonionic surfactant types are:

(a) polyoxyethylene or polyoxypropylene condensates of aliphatic carboxylic acids, whether linear- or branched-chain and unsaturated or saturated, containing from about 8 to about 18 carbon atoms in the aliphatic chain and incorporating from about 2 to about 50 ethylene oxide and/or propylene oxide units. Suitable carboxylic acids include "coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid, (b) polyoxyethylene or polyoxypropylene condensates of aliphatic alcohols, whether linear- or branched-chain and unsaturated or saturated, containing from about 6 to about 24 carbon atoms and incorporating from about 2 to about 50 ethylene oxide and/or propylene oxide units. Suitable alcohols include "coconut" fatty alcohol, "tallow" fatty alcohol, lauryl alcohol, myristyl alcohol and oleyl alcohol. Particularly preferred nonionic surfactant compounds in this category are the "Neodol" type products, a registered trademark of the Shell Chemical Company.

Also included within this category are nonionic surfactants having a formula:

$$R-(\underset{\underset{R^1}{|}}{CH_2CHO})_x(CH_2CH_2O)_y(\underset{\underset{R^2}{|}}{CH_2CHO})_zH$$

wherein R is a linear alkyl hydrocarbon radical having an average of 6 to 18 carbon atoms, $R^1$ and $R^2$ are each linear alkyl hydrocarbons of about 1 to about 4 carbon atoms, x is an integer of from 1 to 6, y is an integer of from 4 to 20 and z is an integer from 4 to 25.

One preferred nonionic surfactant of formula 1 is Poly-Tergent SLF-18® a registered trademark of the Olin Corporation, New Haven, Conn. having a composition of the above formula where R is a $C_6$–$C_{10}$ linear alkyl mixture, $R^1$ and $R^2$ are methyl, x averages 3, y averages 12 and z averages 16. Also suitable are alkylated nonionics as are described in U.S. Pat. No. 4,877,544 (Gabriel et al.), incorporated herein by reference.

Another nonionic surfactant included within this category are compounds of formula $$R^3—(CH_2CH_2O)_qH \qquad \text{I}$$

wherein $R^3$ is a $C_6$–$C_{24}$ linear or branched alkyl hydrocarbon radical and q is a number from 2 to 50; more preferably $R^3$ is a $C_8$–$C_{18}$ linear alkyl mixture and q is a number from 2 to 15.

(c) polyoxyethylene or polyoxypropylene condensates of alkyl phenols, whether linear- or branched-chain and unsaturated or saturated,containing from about 6 to 12 carbon atoms and incorporating from about 2 to about 25 moles of ethylene oxide and/or propylene oxide.

(d) polyoxyethylene derivatives of sorbitan mono-, di-, and tri-fatty acid esters wherein the fatty acid component has between 12 and 24 carbon atoms. The preferred polyoxyethylene derivatives are of sorbitan monolaurate, sorbitan trilaurate, sorbitan monopalmitate, sorbitan tripalmitate, sorbitan monostearate, sorbitan monoisostearate, sorbitan tripalmitate, sorbitan monostearate, sorbitan monoisostearate, sorbital tristearate, sorbitan monooleate, and sorbitan trioleate. The polyoxyethylene chains may contain between about 4 and :50 ethylene oxide units, preferably about 20. The sorbitan ester derivatives contain 1, 2 or 3 polyoxyethylene chains dependent upon whether they are mono-, di- or tri-acid esters.

(e) polyoxyethylene-polyoxypropylene block copolymers having formula:

$$HO(CH_2CH_2O)_a(CH(CH_3)CH_2O)_b(CH_2CH_2O)_cH \qquad \text{III}$$

or $$HO(CH(CH_3)CH_2O)_d(CH_2CH_2O)_e(CHCH_3CH_2O)_fHV$$

wherein a, b, c, d, e and f are integers from 1 to :350 reflecting the respective polyethylene oxide and polypropylene oxide blocks of said polymer. The polyoxyethylene component of the block polymer constitutes at least about 10% of the block polymer. The material preferably has a molecular weight of between about 1,000 and 15,000, more preferably from about 1,500 to about 6,000. These materials are well-known in the art. They are available under the trademark "Pluronic" and "Pluronic R", a product of BASF Corporation.

(f) Alkyl glycosides having formula:

$$R^4O(R^5O)_n(Z^1)_p \qquad \text{V}$$

wherein R4 is a monovalent organic radical (e.g., a monovalent saturated aliphatic, unsaturated aliphatic or aromatic radical such as alkyl, hydroxyalkyl, alkenyl, hydroxyalkenyl, aryl, alkylaryl, hydroxyalkylaryl, arylalkyl, alkenylaryl, arylalkenyl, etc.) containing from about 6 to about 30 (preferably from about 8 to 18 and more preferably from about 9 to about 13) carbon atoms; $R^5$ is a divalent hydrocarbon radical containing from 2 to about 4 carbon atoms such as ethylene, propylene or butylene (most preferably the unit $(R^5O)_n$ represents repeating units of ethylene oxide, propylene oxide and/or random or block combinations thereof); n is a number having an average value of from 0 to about 12; $Z^1$ represents a moiety derived from a reducing saccharide containing 5 or 6 carbon atoms (most preferably a glucose unit); and p is a number having an average value of from 0.5 to about 10 preferably from about 0.5 to about 5.

Within the compositions of the present claim, alkyl polyglycosides will be present in amounts ranging from about 0.01 to about 20% by weight, preferably from about 0.5 to about 10%, optimally between about 1 and 5%.

Examples of commercially available materials from Henkel Kommanditgesellschaft Aktien of Dusseldorf, Germany include APG® 300, 325 and 350 with $R^4$ being $C_9$–$C_{11}$, n is 0 and p is 1.3, 1.6 and 1.8–2.2 respectively; APG® 500 and 550 with $R^4$ is $C_{12}$–$C_{13}$, n is 0 and p is 1.3 and 1.8–2.2, respectively; and APG® 600 with $R^4$ being $C_{12}$–$C_{14}$, n is 0 and p is 1.3. Particularly preferred is APG® 600.

(g) Amine oxides having formula:

$$R^5R^6R^7N{=}O \qquad \text{VI}$$

wherein $R^5$, $R^6$ and $R^7$ are saturated aliphatic radicals or substituted saturated aliphatic radicals. Preferable amine oxides are those wherein $R^5$ is an alkyl chain of about 10 to about 20 carbon atoms and $R^6$ and $R^7$ are methyl or ethyl groups or both $R^5$ and $R^6$ are alkyl chains of about 6 to about 14 carbon atoms and $R^7$ is a methyl or ethyl group.

Amphoteric synthetic detergents can be broadly described as derivatives of aliphatic and tertiary amines, in which the aliphatic radical may be straight chain or branched and wherein one of the aliphatic substituents contain from about 8 to about 18 carbons and one contains an anionic water-solubilizing group, i.e., carboxy, sulpho, sulphato, phosphato or phosphono. Examples of compounds falling within this definition are sodium 3-dodecylamino propionate and sodium 2-dodecylamino propane sulfonate.

Zwitterionic synthetic detergents can be broadly described as derivatives of aliphatic quaternary ammonium, phosphonium and sulphonium compounds in which the aliphatic radical may be straight chained or branched, and wherein one of the aliphatic substituents contains from about 8 to about 18 carbon atoms and one contains an anionic water-solubilizing group, e.g., carboxy, sulpho, sulphato, phosphato or phosphono. These compounds are frequently referred to as betaines. Besides alkyl betaines, alkyl amino and alkyl amido betaines are encompassed within this invention.

Silicates

The compositions of this invention may contain sodium or potassium silicate at a level of from about 1 to about 40%, preferably 1–20% by weight of the cleaning composition. This material is employed as a cleaning ingredient, source of alkalinity, metal corrosion inhibitor and protector of glaze on china tableware. Especially effective is sodium silicate having a ratio of $SiO_2$:$Na_2O$ of from about 1.0 to about 3.3, preferably from about 2 to about 3.2. Some of the silicate may be in solid form.

Filler

An inert particulate filler material which is water-soluble may also be present in cleaning compositions in powder form. This material should not precipitate calcium or magnesium ions at the filler use level. Suitable for this purpose are organic or inorganic compounds. Organic fillers include sucrose esters and urea. Representative inorganic fillers include sodium sulfate, sodium chloride and potassium chloride. A preferred filler is sodium sulfate. Its concentration may range from 0% to 60%, preferably from about 10% to about 30% by weight of the cleaning composition.

Thickeners and Stabilizers

Thickeners are often desirable for liquid cleaning compositions. Thixotropic thickeners such as smectite clays including montrnorillonite (bentonite), hectorire, saponite, and the like may be used to impart viscosity to liquid cleaning compositions. Silica, silica gel, and aluminosilicate may also be used as thickeners. Salts of polyacrylic acid (of molecular weight of from about 300,000 up to 6 million and higher), including polymers which are cross-linked may also be used alone or in combination with other thickeners. Use of clay thickeners for automatic dishwashing compositions is disclosed for example in U.S. Pat. Nos. 4,431,559; 4,511,487; 4,740,327; 4,752,409. Commercially available synthetic smectite clays include Laponite supplied by Laporte Industries. Commercially available bentonire clays include Korthix H and VWH ex Combustion Engineering, Inc.; Polargel T ex American Colloid Co.; and Gelwhite clays (particularly Gelwhite GP and H) ex English China Clay Co. Polargel T is preferred as imparting a more intense white appearance to the composition than other clays. The amount of clay thickener employee in the compositions is from 0.1 to about 10%, preferably 0.5 to 5%. Use of salts of polymeric carboxylic acids is disclosed for example in UK Patent Application GB 2,164,350A, U.S. Pat. No. 4,859,358 and U.S. Pat. No. 4,836,948.

For liquid formulations with a "gel" appearance and rheology, particularly if a clear gel is desired, a chlorine stable polymeric thickener is particularly useful. U.S. Pat. No. 4,260,528 discloses natural gums and resins for use in clear autodish detergents, which are not chlorine stable. Acrylic acid polymers that are cross-linked manufactured by, for example, B.F. Goodrich and sold under the trade name "Carbopol" have been found to be effective for production of clear gels, and Carbopol 940 and 617, having a molecular weight of about 4,000,000 is particularly preferred for maintaining high viscosity with excellent chlorine stability over extended periods. Further suitable chlorine-stable polymeric thickeners are described in U.S. Pat. No. 4,867,896 incorporated by reference herein.

The amount of thickener employed in the compositions is from 0 to 5%, preferably 0.5–3%.

Stabilizers and/or co-structurants such as long chain calcium and sodium soaps and $C_{12}$ to $C_{18}$ sulfates are detailed in U.S. Pat. Nos. 3,956,158 and 4,271,030 and the use of other metal salts of long chain soaps is detailed in U.S. Pat. No. 4,752,409. Other co-structurants include Laponite and metal oxides and their salts as described in U.S. Pat. No. 4,933,101, herein incorporated by reference. The amount of stabilizer which may be used in the liquid cleaning compositions is from about 0.01 to about 5% by weight of the composition, preferably 0.01–2%. Such stabilizers are optional in gel formulations. Co-structurants which are found especially suitable for gels include trivalent metal ions at 0.01–4% of the compositions, Laponite and/or water-soluble structuring chelants at 1–60%. These co-structurants are more fully described in the co-pending U.S. patent application Ser. No. 139,492, by Cotring et al., filed Dec. 30, 1987, which application is hereby incorporated by reference.

Defoamer

The formulations of the cleaning composition comprising surfactant may further include a defoamer. Suitable defoamers include mono- and distearyl acid phosphate, silicone oil and mineral oil. Even if the cleaning composition has only defoaming surfactant, the defoamer assists to minimize foam which food soils can generate. The compositions may include 0.02 to 2% by weight of defoamer, or preferably 0.05–1.0%.

Minor amounts of various other components may be present in the cleaning composition. These include bleach scavengers including but not limited to sodium bisulfite, sodium perborate, reducing sugars, and short chain alcohols; solvents and hydrotropes such as ethanol, isopropagol and xylene sulfonates; flow control agents (in granular forms); enzyme stabilizing agents; soil suspending agents; antiredeposition agents; anti-tarnish agents; anti-corrosion agents; colorants; other functional additives; and perfume. The pH of the cleaning composition may be adjusted by addition of strong acid or base. Such alkalinity or buffering agents include sodium carbonate and sodium borate.

Enzymes

Enzymes capable of facilitating the removal of soils from a substrate may also present in the invention in an amount of from about 0 to 10 weight percent, preferably 1 to about 5 weight percent. Such enzymes include proteases (e.g., Alcalase®, Savinase® and Esperase® from Novo Industries A/S), amylases (e.g., Termamyl® from Novo Industries A/S)lipases (e.g., Lipolase® from Novo Industries A/S) and oxidases or mixtures thereof.

The pH Of a 1% solution of the compositions should be about 7 to about 13, preferably about 7 to about 11, most preferably 7 to about 10.

The following examples will more fully illustrate the embodiments of the invention. All parts, percentages and proportions referred to herein and in the appended claims are by weight unless otherwise indicated.

EXAMPLE 1

The following seven (7) machine dishwashing compositions were prepared as follows:

| Ingredient | % by weight |
|---|---|
| Sodium Citrate ($2H_2O$) | 30.0 |
| Sodium Tetraborate | 3.0 |
| Glycerol | 6.0 |
| Sokalan CP7 (40%)[1] | 5.0 |
| Sodium Hydroxide (50%) | 1.6 |
| Bleaching Agent[2] | x |
| Anti-tarnish Agents[3] | y |
| Water | to 100 |

[1]an acrylic acid/maleic acid copolymer supplied by BASF Corporation of Parsippany, New Jersey.

[2]The following different levels of sodium perborate ($H_2O$) and TAED (N,N,N',N'-tetraacetylethylene diamine bleach activator) were used in example 1:

a. 0.0% sodium perborate ($H_2O$) and 0.0% TAED
b. 0.5% sodium perborate ($H_2O$) and 0.3% TAED
c. 0.7% sodium perborate ($H_2O$) and 0.5% TAED
d. 0.9% sodium perborate ($H_2O$) and 0.6% TAED
e. 1.3% sodium perborate ($H_2O$) and 0.9% TAED
f. 1.7% sodium perborate ($H_2O$) and 1.1% TAED
g. 6.8% sodium perborate ($H_2O$) and 4.3% TAED

[3]No anti-tarnish agent was used in example 1.

Tarnish monitoring experiments to determine silver tarnishing were conducted with compositions a, b, c, d, e, f, and g at a product dosage of 40 grams per run in a European dishwasher, Bauknecht GSF 3162, with an intake of 5 liters deionized water. The wash program consisted of a pre-wash at 40° C., a mainwash at 55° C., two intermediate rinses, and a final rinse at 65° C. The mainwash pH with these compositions was typically about 8.7. Silverplated spoons (2 per run) were the monitors used in the test. The spoons were supplied by Oneida Silversmiths, USA. The monitors were washed in a commercially available hand dishwash liquid and rinsed with deionized water and acetone before use. In the dishwasher the monitors were kept apart from each other in the cutlery basket. At the end of a single-run machine program, the monitors were visually analyzed for the presence of colors and the loss of gloss.

The spoons washed with composition a were unchanged after the dishwashing process, except for a few stain spots. The stain spots were caused by deposition of non-volatile materials during the evaporation of undrained wash solution in the drying step of the machine program and are not related to a tarnishing (i.e., silver oxidation) process of the monitors.

However, the spoons washed with compositions b, c, d, e, f, and g were increasingly tarnished as the levels of bleaching agent were increased. The spoons washed with composition g were so heavily tarnished that they lost their gloss and were turned brown/black. The set of spoons washed with the compositions a, b, c, d, e, f, and g were ranked from zero to six, respectively. This ranking of spoons was used as a reference scale for all subsequent examples.

EXAMPLE 2

Three (3) machine dishwashing compositions were prepared as described in Example 1 except a chlorine bleaching agent and an anti-tarnish agent were combined as follows:

Composition

A: Sodium dichloroisocyanurate (CDB, supplied by Olin Corporation of Stamford, Conn.) was incorporated as a bleaching agent at a 2.2% level; no anti-tarnish agent was used.

B: Sodium hypochlorite (an 8.2% active $Cl_2$ solution supplied by Jones Chemicals from Caledonia, N.Y.) was incorporated as a bleaching agent at a 8.23% level; no anti-tarnish agent was used.

C: Sodium hypochlorite (an 8.2% active $Cl_2$ solution) was incorporated as a bleaching agent at a 8.23% level; cyanuric acid (supplied by Aldrich Chemical Co. of Milwaukee, Wis.) was incorporated as an anti-tarnish agent at a 1% level.

Tarnish monitoring experiments as described in Example 1 were conducted with compositions A–C using 2 silver-plated spoons as monitors in each of the experiments. The mainwash pH in this series of experiments was typically about 8.7.

The influence of the compositions A, B, and C on silver tarnishing are shown in the following table. The anti-tarnish scale ranks from 0–6, according to the levels of tarnishing obtained with the compositions a to g of Example 1.

TABLE 1

| Composition | Tarnish Score |
|---|---|
| A | 1.5 |
| B | 5.5 |

TABLE 1-continued

| Composition | Tarnish Score |
|---|---|
| C | 0 |

It was observed that spoons washed with composition C, containing 1% cyanuric acid, remained unchanged during the dishwashing process. In contrast, composition B, in which hypochlorite was incorporated without cyanuric acid, produced quite heavy tarnishing. Composition A containing sodium dichloroisocyanurate but not anti-tarnishing agent exhibited little silver tarnishing. It is believed that isocyanurate is formed during a wash in which sodium dichloroisocyanurate is used. Isocyanurate can be formed upon dissociation of dichloroisocyanurate, producing hypochlorite as the active bleaching species. This is also believed to explain why chloroisocyanurate bleach systems generally do not cause many problems in terms of silver tarnishing.

EXAMPLE 3

Six (6) machine dishwashing compositions were prepared as described in Example 1 except the bleaching agent and anti-tarnish agent were varied as follows:

| Compositions | Bleaching Agent | Cyanuric Acid[4] |
|---|---|---|
| A | Peracetic acid[1] - 4.12% | 0% |
| B | Peracetic acid[1] - 4.12% | 1.0% |
| C | Epsilon-phthalimidoperoxy-hexanoic acid[2] - 4.0% | 0% |
| D | Epsilon-phthalimidoperoxy-hexanoic acid[2] - 4.0% | 1.0% |
| E | Sodium hypochlorite-8.23%[3] | 0% |
| F | Sodium hypochlorite-8.23%[3] | 1.0% |

[1]a 32% peracetic acid solution supplied by Aldrich Corp. of Milwaukee, WI
[2]supplied by Hoechst AG of Germany
[3]a 8.2% active $Cl_2$ solution supplied by Jones Chemicals of Caledonia, NY
[4]supplied by Aldrich Corp.

Tarnish monitoring experiments were conducted using compositions, A, B, C, D, E and F at a product dosage of 40 grams per run in a Bauknecht GSF 3162 dishwasher, with an intake of 5 liters water. The mainwash pH values for compositions A and B were adjusted to 7.5; the mainwash DH values for compositions C and D were adjusted to 8.5. Two experiments (each) were conducted using compositions E and F; the mainwash pH values were adjusted to 9.0 and 10.5, respectively. Silver plated spoons, knives, and forks (supplied by Oneida Silversmiths, USA), were used as monitors for all experiments. The monitors were washed in a commercially available dishwashing liquid and rinsed with deionized water and acetone before use. At the end of the dishwashing machine program, the monitors were visually evaluated for the presence of colors and/or loss of shine, according to the reference scale described in Example 1.

In each case above, the presence of cyanuric acid reduced the level of tarnishing relative to the case when no inhibitor was present. While tarnishing inhibition due to cyanuric acid occurs throughout the pH range described above, this effect is greater at higher alkalinity. At pH 7.5, t:he introduction of cyanuric acid lead to a reduction of 1.5 units of tarnishing; at pH 10.5 the reduction in tarnishing was 3.0 units. Furthermore, cyanuric acid reduces tarnishing irrespective to the type of bleaching agent present in the composition; inhibition is noted for both chlorine and oxygen bleaches.

EXAMPLE 4

Five (5) machine dishwashing compositions were prepared as described in Example 1 except that epsilon-phthalimidoperoxyhexanoic acid was introduced as the peroxygen bleaching agent and cyanuric acid was introduced at five different amounts as follows:

| Composition | Epsilon-phthalimidoperoxy hexanoic acid[1] | Cyanuric Acid[2] |
|---|---|---|
| A | 4.0% | 0% |
| B | 4.0% | 0.25% |
| C | 4.0% | 0.75% |
| D | 4.0% | 1.0% |
| E | 4.0% | 2.5% |

[1]supplied by Hoechst AG, Germany
[2]supplied by Aldrich Co.

As described in Example 1, tarnish monitoring tests were conducted with compositions A–E using two silver-plated spoons as monitors in each of the experiments. The mainwash pH in this series of experiments was typically between 8.8 and 8.5.

The effect of the compositions A–E on silver tarnishing are shown in Table 3. The anti-tarnish scale ranks from 0–6, according to the levels of tarnishing obtained with the compositions a to g of Example 1.

TABLE 3

| Composition | Tarnish Score |
|---|---|
| A | 5 |
| B | 4.5 |
| C | 3 |
| D | 0.5 |
| E | 0.8 |

It can be seen from this table that the level of cyanuric acid which gives optimum anti-tarnish performance is about 1%. The monitors had a slightly yellow appearance after using cyanuric acid at a 2.5% level.

We claim:

1. A detergent composition comprising:
   a) 1 to 20 weight percent of a bleaching agent selected from the group of a peroxygen agent, a hypohalite agent and its corresponding salts, and mixtures thereof;
   b) 0.05 to about 10 weight percent of an anti-tarnishing agent selected from a group consisting essentially of unsubstituted cyanuric acid, isocyanuric acid, salts corresponding to the cyanuric acid and the isocyanuric acid, and mixtures thereof;
   c) 1 to 75 weight percent of a builder; and
   d) 0 to 40 weight percent of a surfactant.

2. A detergent composition according to claim 1 wherein the peroxygen agent is an organic or inorganic agent.

3. A detergent composition according to claim 2 wherein the organic agent is selected from a group consisting of epsilon-phthalimidoperoxy hexanoic acid, o-carboxybenzamido peroxyhexanoic acid, and N,N-terephthaloyl-di(6-aminopercaproic acid) and mixtures thereof.

4. A detergent composition according to claim 2 wherein the inorganic agent is selected from the group consisting of salts of monopersulfate, perborate monohydrate, perborate tetrahydrate, percarbonate and mixtures thereof.

5. A detergent composition according to claim 1 further comprising a peroxygen peracid precursor.

6. A detergent composition according to claim 5 wherein the peroxygen peracid precursor is selected from a group consisting of sodium p-benzoyloxybenzene sulfonate, N,N,N',N'-tetraacetyl ethylene diamine, sodium nonanoyloxybenzene sulfonate and chlorine sulfophenyl carbonate.

7. A detergent composition according to claim 1 wherein the hypohalite agent is sodium hypochlorite.

8. A detergent composition according to the claim 1 wherein the builder is selected from the group consisting of alkali metal citrates, succinates, tartrate-disuccinates, polycarboxylates, aluminosilicates, and mixtures thereof.

9. A detergent composition according to claim 1 wherein the antitarnishing agent is present in an amount of from about 0.25 to about 2.5 weight percent.

10. A detergent composition according to claim 1 further comprising about 0.1 to about 40 weight percent of an alkalinity agent.

11. A detergent composition according to claim 1 further comprising an enzyme in an amount of up to about 10 weight percent.

12. A detergent composition according to claim 1 wherein a 1% solution of the composition has a pH value in the range of from 7 to about 13.

13. A detergent composition according to claim 1 wherein the surfactant is an alkoxylated nonionic surfactant.

14. A method for substantially preventing tarnishing of silver or silver plated articles comprising the steps of: washing silver or silver plated articles in an effective amount of a detergent composition having the composition:

a) 1 to 20 weight percent of a bleaching agent selected from the group of a peroxygen agent, a hypohalite agent and its corresponding salts, and mixtures thereof;

b) 0.05 to about 10 weight percent of an anti-tarnishing agent selected from a group consisting essentially of unsubstituted cyanuric acid, isocyanuric acid, salts corresponding to the cyanuric acid and the isocyanuric acid, and mixtures thereof;

c) 1 to 75 weight percent of a builder; and d) 0 to 40 weight percent of a surfactant;

to substantially prevent tarnishing of silver or silver-plated articles during a washing process.

15. A method according to claim 10 wherein the peroxygen bleaching agent is an organic or inorganic agent.

16. A detergent composition according to claim 15 wherein the organic agent is selected from the group consisting of epsilon-phthalimidoperoxy hexanoic acid, o-carboxybenzamido peroxyhexanoic acid, and N,N-terephthaloyl-di(6-aminopercaproic acid) and mixtures thereof.

17. A detergent composition according to claim 15 wherein the inorganic agent is selected from the group consisting of salts of monopersulfate, perborate monohydrate, perborate tetrahydrate, percarbonate and mixtures thereof.

18. A method according to claim 14 wherein the hypohalite agent is sodium hypochlorite.

19. A detergent composition according to claim 1 further comprising a peroxygen peracid precursor.

* * * * *